United States Patent [19]

Summers

[11] 4,013,870

[45] Mar. 22, 1977

[54] TERMINAL BLOCK MOUNTING FOR A PLUG-IN SURFACE HEATING UNIT

[75] Inventor: Glen H. Summers, Elmhurst, Ill.

[73] Assignee: General Electric Company, Louisville, Ky.

[22] Filed: June 4, 1976

[21] Appl. No.: 692,956

[52] U.S. Cl. ..... 219/451; 219/447; 219/463; 219/467; 339/14 L

[51] Int. Cl.[2] ..... H05B 3/68

[58] Field of Search ..... 219/447, 451, 455, 463, 219/467, 541; 339/14 L, 65, 191 R

[56] References Cited

UNITED STATES PATENTS

| | | | |
|---|---|---|---|
| 3,328,562 | 6/1967 | Jasionowski | 219/451 |
| 3,346,719 | 10/1967 | Jasionowski | 219/451 |
| 3,443,064 | 5/1969 | Meng | 219/451 |
| 3,506,805 | 4/1970 | Sauder | 219/451 |
| 3,571,562 | 3/1971 | Cunningham | 219/451 |
| 3,767,897 | 10/1973 | Prucha et al. | 219/451 |
| 3,781,757 | 12/1973 | Barnes | 339/14 L |

*Primary Examiner*—Volodymyr Y. Mayewsky
*Attorney, Agent, or Firm*—Richard L. Caslin; Francis H. Boos

[57] ABSTRACT

A plug-in surface heating unit assembly for use in the cooktop of an electric range. The heating unit is a metal sheathed electrical resistance heating element in spiral form with radial, outwardly directed terminal portions in close formation. The invention relates to a folded spring blade which is fastened between a movable terminal block and the cooktop so that the spring normally biases the terminal block into an upward position while biasing the heating unit into a down position so that the unit will sit level with respect to the cooktop. The terminal block is supported by means of a lost-motion connection from a fixed mounting bracket that is supported under the cooktop.

5 Claims, 4 Drawing Figures

TERMINAL BLOCK MOUNTING FOR A PLUG-IN SURFACE HEATING UNIT

BACKGROUND OF THE INVENTION

1. Field of the Invention:

This invention relates to the electric range art, and particularly to a combined mounting bracket and terminal block for a plug-in surface heating unit supported in the cooktop.

2. Description of the Prior Art:

The most popular form of surface heating unit is a metal sheathed electrical resistance heating element in open spiral form, and, occasionally, grease spatter and food spillage will pass down between the spiral coils and accumulate in a pan under the cooktop. These accumulated soils should be removed periodically so that they do not become a safety hazard or begin to contaminate the range. If the heating units are removable, then this cleaning problem is lessened.

In the prior art, there are two main types of movable surface heating units. The first type comprises hinged units which may be raised up at an angle so that the reflector pan beneath the unit may be removed and the underlying pan wiped clean.

The second and most common type of movable heating units comprises plug-in heating units having a separable terminal block mounted beneath the cooktop so that the heating unit may be easily unplugged from the cooktop. An example is shown in U.S. Pat. No. 3,767,897 of Prucha/Bowling, which is assigned to the present assignee. The heating unit is provided with plugin terminals which are insertable into sockets in a separable terminal block. Thus, the surface unit can be unplugged from the terminal block almost in the same manner as unplugging an attachment plug of an electrical cordset from a convenience outlet mounted in the wall of a room. One important advantage of a plug-in surface heating unit is that it is easy for the average person to remove and replace the unit without the need of an appliance service man. It is important that the surface heating unit, when installed, must rest in a level position, so that in a cooktop with four heating units they all lie within a single plane, and one does not stick up higher than the others. One important objection to a heating unit that is not seated firmly in a level position is that it might otherwise tend to vibrate and make noise when other motor-operated applicances are being used in the kitchen; or when a person walks across the kitchen floor.

The principal object of the present invention is to provide a plug-in surface heating unit with a prestressed spring means for use with the separable terminal block that allows for vertical movement of the terminal block as well as exerts a biasing force to move the heating element into a level resting position.

A further object of the present invention is to provide a plug-in surface heating unit assembly of the class described, with a folded spring blade that is capable of temporarily clamping the terminal block and its mounting bracket to the cooktop prior to installing the fastening means.

A further object of the present invention is to provide a plug-in surface heating unit assembly of the class described where the folded spring blade includes an elongated cantilever section that provides both angular and vertical freedom of movement of the terminal block.

SUMMARY OF THE INVENTION

The present invention, in accordance with one form thereof, relates to a plug-in surface heating unit assembly having a fixed mounting bracket and a movable terminal block supported from the bracket by a lost-motion fastening means. A folded spring blade joins the terminal block to the cooktop. The spring blade has a top tab seated on the cooktop, and a vertical midsection for fastening the blade to the cooktop, and a lower cantilever spring section so as to bias the terminal block into its uppermost position with respect to the mounting bracket.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
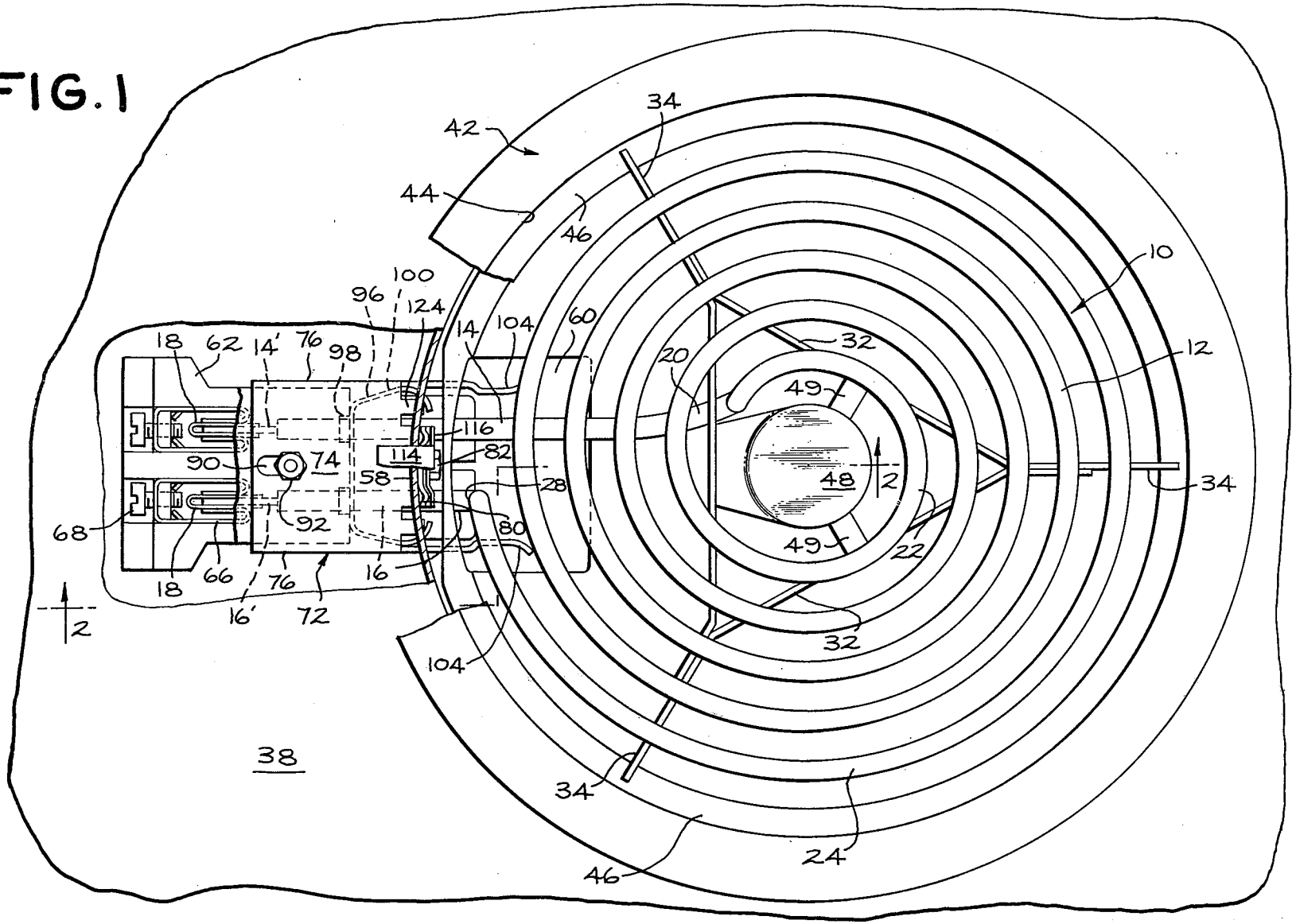
FIG. 1 is a top plan view of a plug-in surface heating unit mounted in a cooktop and plugged into a separate terminal block that is support from a mounting bracket beneath the cooktop, with a part of the cooktop broken away in the area over the mounting bracket and terminal block, and the electrical parts of the terminal block shown in dotted lines.

Turning now to a consideration of the drawings, and in particular to the plan view of FIG. 1, there is shown a plug-in surface heating unit 10. This heating unit comprises a metal sheathed electrical resistance heating element 12 that is of open spiral configuration of standard design. Notice this heating element 12 has two terminal end portions 14 and 16 beneath the spiral coil which are arranged in close side-by-side relation and extend in a radial, outward direction. Each terminal portion 14 and 16 has an unheated end that terminates in a terminal wire 14' and 16', respectively, and each terminal wire is provided with a doubled-over spring contact 18. The heating element 12 extends from the first terminal portion 14 horizontally inward toward the center of the heating unit, and then rises vertically, as at 20, to the plane of the spiral coil, and it is then wound into the first small-diameter coil 22, and then spirals in a gradually increasing radius until it finishes the largest-diameter coil 24 which then is turned down vertically, as at 28. Then the heating element extends horizontally outwardly, as terminal 16 in a generally parallel relationship with the first terminal portion 14, as is best seen in FIG. 1.

These spiral coils of the heating element 12 are relatively flexible in a vertical direction. Hence, these coils are supported by a triangular framework or spider 32 of vertically disposed metal strips which are fastened together as by spot welding. At each apex of the triangle, there is an outwardly directed radial arm 34 which extends beyond the outermost coil 24 to assist in supporting the heating element. The heating unit 10 is adapted to be recessed into a cooktop 38, and this is done by forming a circular cutout opening in the cooktop in which the heating unit is positioned. A decorative trim ring 42 is adapted to overlie the peripheral edge of the opening in the cooktop. The inner peripheral edge 44 of the trim ring is formed down to extend slightly into the cooktop opening, and it is also formed with a lower internal ledge 46 for supporting the tips of the radial arms 34 of the spider 32 of the heating unit, as is best seen in FIG. 1. An identifying medallion 48 is located in the center of the heating unit within the smallest coil 22 and it is supported by radial tabs 49 from the spider 32.

Figure 3:
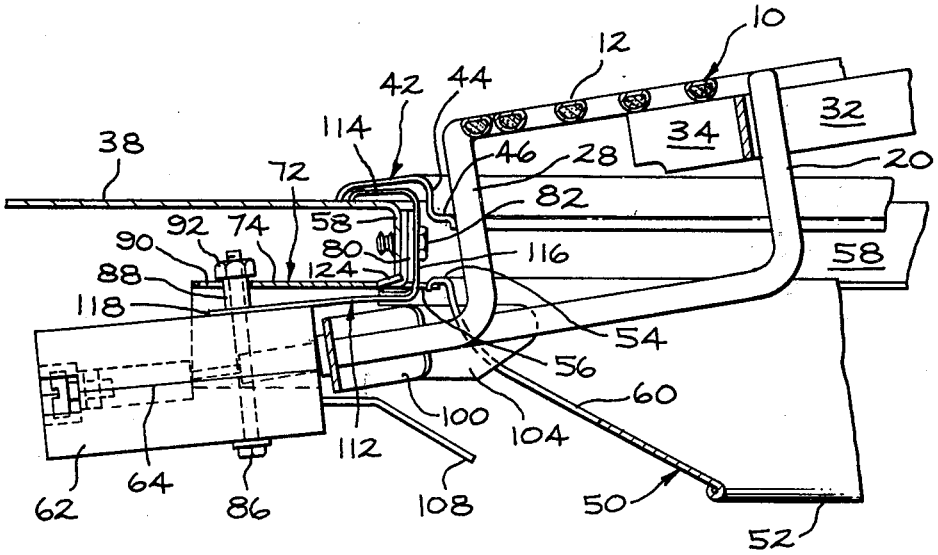
FIG. 3 is a fragmentary cross-sectional elevational view similar to that of FIG. 2, but showing the surface heating unit raised to an inclined position as a step in the removal or insertion of the terminal portions of the heating unit into the sockets of the terminal block. Notice the relative change of position of the terminal block with relation to the fixed mounting bracket in FIG. 3 as compared with FIG. 2.

Positioned beneath the heating element 12 is a removable reflector pan 50, as best seen in FIG. 3, which is of dished configuration having a central drain opening 52 and an outwardly directed horizontal flange 54 at its upper edge that is adapted to seat upon a ledge 56 that extends inwardly from a lower edge of a vertical flange 58 that extends downwardly from the peripheral edge of the opening in the cooktop 38. A large notch 60 is formed in the top edge of the reflector pan 50 in the vicinity of the terminal portions 14 and 16 of the heating element of the surface unit to allow the terminal portions to extend out through the notch and into cooperation with a dielectric terminal block 62.

Figure 2:
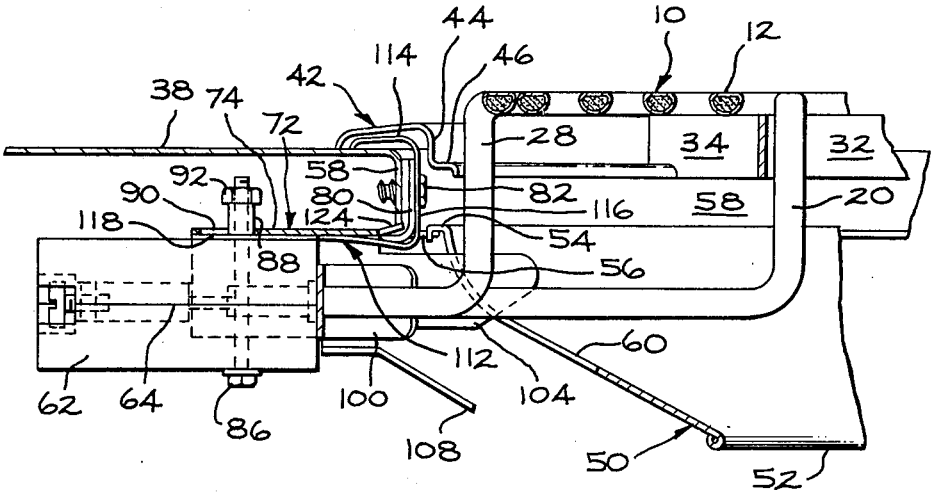
FIG. 2 is a fragmentary cross-sectional elevational view taken on the line 2—2 of FIG. 1 and showing a side view of the fixed mounting bracket and the movable terminal block supported therefrom for making an electrical connection with the terminal portions of the surface heating unit. The surface unit is shown in its normal use position.

The terminal block 62 is a generally hollow housing formed of molded ceramic insulating material that is split horizontally into two halves, as at 64, for ease in molding the two parts and for installing vertically arranged spring contacts 66 within separated sockets so as to electrically insulate one contact from the other. Each spring contact 66 is provided with a terminal screw 68 at the back end of the terminal block for making an electrical connection with a lead wire (not shown). Notice that the doubled-over contacts 18 of the terminals 14' and 16' are vertically disposed and that they are received within the vertically arranged spring contacts 66 of the terminal block. Thus, the terminal contacts 18 of the heating unit 10 are free to pivot in a vertical plane within the spring contacts 66 of the terminal block 62 so that the terminal block does not prevent the heating unit from assuming a level position, as is shown in FIG. 2.

It is necessary to provide a mechanical support means for the terminal block 62 and this is afforded by a channel-like sheet metal mounting bracket 72 which is of folded construction having a top wall 74 and opposite side walls 76. The mounting bracket 72 does not underlie the terminal block, but, in effect, straddles it so that the block may move vertically within the bracket. As is best seen in FIG. 3, the mounting bracket 72 has a vertical top flange 80 which is adapted to fit against the inner side of the vertical flange 58 that forms the peripheral edge of the cooktop opening. This flange 80 is a mounting flange and it has a hole for receiving a fastening screw 82 therethrough, which screw is also threaded into a suitable opening in the vertical flange 58. Thus, the mounting bracket 72 is rigidly supported from the cooktop.

The two-piece terminal block 62 is held together by a vertical through bolt 86 which is insulated by the block from the electrical current-carrying parts of the block. A short sleeve 88 is slipped over the top end of the bolt and this sleeve fits through an elongated slot 90 in the top wall 74 of the mounting bracket 72. Then, a lock nut 92 is threaded onto the bolt 86 and tightened in place. This bolt 86, sleeve 88, and nut 92 serve as a lost-motion fastening means between the terminal block 62 and the mounting bracket 72, so that the terminal block is capable of moving in a vertical direction a limited amount while the mounting bracket remains fixed, as is best seen by comparing the normal operating position of FIG. 2 with the showing of FIG. 3 where the heating element has been raised about 15° which causes the terminal block to be lowered into an inclined position for ease in withdrawing the terminals from the terminal block.

It is necessary to electrically ground the metal sheath of the heating element 12 with the mounting bracket 72 and through it to the cooktop 38. This is accomplished by providing the terminal protions 14 and 16 with a resilient, generally U-shaped, grounding clip 96, which is best seen in the plan view of FIG. 1. This clip 96 has a central portion with apertures for receiving terminals 14 and 16 therethrough and the clip is crimped in place, as at 98. The opposite sides of the grounding clip 96 are provided with resilient fingers 100 which are adapted to bear against side arms 104 that are actually front extensions of the side walls 76 of the mounting bracket 72. Thus, these resilient arms 100 make a wiping contact with the side arms 104 of the mounting bracket whenever the terminals of the heating element are inserted or removed from the terminal block. In addition, a lower downwardly inclined ramp 108 extends forwardly of the mounting bracket to assist in guiding the terminals of the heating unit into the terminal block, which is important because the terminal block is somewhat hidden from view beneath the cooktop when a person is trying to insert or withdraw the heating unit from the terminal block.

The present invention differs mainly from the prior Prucha/Bowling U.S. Pat. No. 3,767,897 because the patent includes a flexible coupling spring between the inclined ramp 108 of the mounting bracket and the terminal block 62. This coupling spring has been removed from the present invention and a folded spring blade 112, as is shown in detail in FIG. 4, has been installed between the cooktop 38 and the upper portion of the terminal block 62 to provide improved results. The spring blade 112 is folded into three sections, a top tab 114 that is adapted to overlie the top peripheral edge of the cooktop opening, a vertical midsection 116 that is adapted to bear against the top flange 80 of the mounting bracket and to receive the same fastening screw 82, and an elongated cantilever section 118 which is adapted to overlie the top surface of the terminal block 62. This cantilever section 118 has a hole 120 for receiving the through bolt 86, such that the sleeve 88 bears down upon the cantilever section and clamps the spring against the terminal block.

Figure 4:
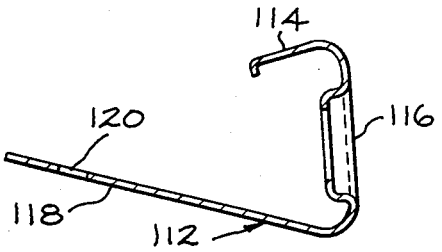
FIG. 4 is an enlarged view of the folded spring blade of the present invention in its unassembled position showing the top tab and the lower cantilever section formed inwardly toward each other so that when it is assembled in place between the movable terminal block and the cooktop, the spring will take right angular formations and become prestressed, as is best seen in FIG. 2.

Notice, in FIG. 4, in the preassembled condition of the spring blade, the top tab 114 and the cantilever section 118 are formed toward each other such that when the spring blade 112 is attached to the terminal block 62 by means of the bolt 86 and nut 92, then the combined terminal block and mounting bracket are slipped under the cooktop and under the flange 58 thereof so that the tab 114 engages the top of the cooktop and serves as a temporary support means. The front edge of the top wall 74 of the mounting bracket 72 is formed with a pair of raised anti-torque tabs 124 which are adapted to underlie the bottom edge of the cooktop flange 58 in a tight gripping action due to the flexing of the top tab 114 of the spring blade 112. Thus, the spring blade grips the cooktop and causes the combined terminal block and mounting bracket to be temporarily self-supporting. Thus, in the assembled condition of the spring blade 112, as shown in FIG. 2, the spring blade is prestressed which normally exerts an upward force on the cantilever section 118 of the spring which biases the terminal block 62 into its upward position with relation to the mounting bracket and, at the same time, exerts a force to move the heating element 10 down into a flat seated position on the trim ring 42.

The closest prior art reference to the present invention appears to be that of the Cunningham U.S. Pat. No. 3,571,562, which shows a terminal block fixed with respect to its mounting bracket. However, the mounting bracket is provided with a connecting member of spring sheet metal that is formed with a spring loop extension which terminates in a vertical ear that is fastened to the cooktop. In this Cunningham patent, the mounting bracket is resiliently supported from the cooktop by means of a spring loop connecting means. In the present invention, the mounting bracket is rigid and the terminal block is connected by a lost-motion fastening means to the mounting bracket, and there is a folded spring blade joined to the cooktop and to the terminal block to allow for both angular and vertical freedom of movement of the terminal block for ease of connecting and withdrawing the terminals of the heating unit from the terminal block. In the Cunningham design, the spring loop can be disfigured easily if it is mishandled and the design would be inoperative, while in the present invention the folded spring blade is protected from damage by the through bolt 86 and its locking nut 92 when the heating element is in its raised position of FIG. 3, and the spring blade is protected in its opposite position by the terminal block 62 abutting against the mounting bracket, as best seen in FIG. 2, as well as the heating unit resting on the trim ring. Thus, the folded spring blade of the present invention incorporates a built-in protection means which is reliable in operation for the expected life of the equipment so the spring blade cannot be easily damaged and rendered inoperative.

Modifications of this invention will occur to those skilled in this art. Therefore, it is to be understood that this invention is not limited to the particular embodiments disclosed, but that it is intended to cover all modifications which are within the true spirit and scope of this invention as claimed.

I claim:

1. In a terminal block assembly for a plug-in surface heating element supported in an opening in a cooktop, the heating element is a metal sheathed electrical resistance element of spiral form with radial, outwardly-directed, terminal portions in close formation which plug into a dielectric terminal block, a sheet metal mounting bracket rigidly fastened to the cooktop, and lost-motion fastening means for supporting the terminal block from the mounting bracket for limited freedom of vertical and angular movement therebetween, the improvement comprising a resilient means for biasing the movable terminal block into its uppermost position with respect to the mounting bracket, said spring means being a folded spring blade having a tab at the top for seating on the cooktop, a vertical midsection that is fastened to the cooktop and an elongated cantilever section underlying the cooktop and fastened to the top of the terminal block, so as to normally bias the terminal block to its uppermost position with respect to the mounting bracket.

2. In the invention of claim 1 wherein the said mounting bracket has a vertical tab with fastening means for holding the bracket to the cooktop, this last-mentioned fastening means also holding the vertical section of the spring blade to the cooktop.

3. In the invention of claim 2 wherein the opening in the cooktop is provided with a vertical peripheral flange of a height slightly less than the height of the vertical midsection of the folded spring blade so that the spring blade may be slipped into a clamping relationship with the cooktop flange for temporarily supporting the attached terminal block and mounting bracket prior to attachment of the fastening means.

4. In the invention of claim 3 wherein a decorative trim ring overlies the peripheral edge of the cooktop opening, the trim ring having an internal peripheral edge formed down into the opening, the top tab of the spring blade underlying the trim ring and serving to center the trim ring within the cooktop opening, the trim ring having support means for receiving the heating element thereon.

5. In the invention of claim 1 wherein the folded spring blade in its preassembled condition has the top tab and the cantilever spring section formed in toward each other so that when the spring blade is fastened to the terminal block and through it to the mounting bracket and then clamped over the edge of the cooktop opening, the spring blade becomes prestressed into substantially right angular formations so as to bias the heating element to sit down flat with respect to the cooktop.

* * * * *